US007291246B2

(12) United States Patent
Norborg et al.

(10) Patent No.: US 7,291,246 B2
(45) Date of Patent: Nov. 6, 2007

(54) LIQUID BOARD

(75) Inventors: Klas Norborg, Karlstad (SE); Mikael Hjerpe, Karlstad (SE); Kajsa von Schalien, Karlstad (SE)

(73) Assignee: Stora Enso Aktiebolag, Falun (SE)

( * ) Notice: Subject to any disclaimer, the term of this patent is extended or adjusted under 35 U.S.C. 154(b) by 299 days.

(21) Appl. No.: 10/312,013

(22) PCT Filed: Jun. 19, 2001

(86) PCT No.: PCT/SE01/01383

§ 371 (c)(1),
(2), (4) Date: Dec. 23, 2002

(87) PCT Pub. No.: WO01/98587

PCT Pub. Date: Dec. 27, 2001

(65) Prior Publication Data

US 2003/0141026 A1 Jul. 31, 2003

(30) Foreign Application Priority Data

Jun. 22, 2000 (SE) ..... 0002343

(51) Int. Cl.
*D21F 11/00* (2006.01)

(52) U.S. Cl. ..... 162/125; 162/127; 162/128; 162/158; 162/164.1; 428/34.6

(58) Field of Classification Search ..... 162/125, 162/127, 128, 158, 169.1; 428/34.6
See application file for complete search history.

(56) References Cited

U.S. PATENT DOCUMENTS

| | | | | |
|---|---|---|---|---|
| 3,127,274 | A * | 3/1964 | Weinke | 426/8 |
| 4,031,285 | A * | 6/1977 | Miller et al. | 428/294.7 |
| 4,927,496 | A | 5/1990 | Walkden | |
| 5,308,441 | A | 5/1994 | Kern | |
| 5,456,800 | A | 10/1995 | Tansley et al. | |

FOREIGN PATENT DOCUMENTS

| | | |
|---|---|---|
| SE | 502 090 C2 | 8/1995 |

* cited by examiner

*Primary Examiner*—Mark Halpern
(74) *Attorney, Agent, or Firm*—Jeffrey S. Melcher; Manelli Denison & Selter, PLLC

(57) ABSTRACT

The invention relates to liquid board comprising one or more layers of material containing cellulose, one or more of said layers comprising an additive that has the capacity to react with or decompose a disinfectant with which said liquid board is treated, so that a gas is formed that acts as a barrier and thereby prevents the penetration, especially edge penetration, of said disinfectant into the paperboard layer/layers.

14 Claims, 1 Drawing Sheet

LIQUID BOARD

This application is the U.S. National Phase of International Application PCT/SE01/01383, filed 19 Jun. 2001, which designated the U.S. PCT/SE01/01383 claims priority to Swedish Application No. 0002343-2 filed 22 Jun. 2000. The entire content of these applications are incorporated herein by reference.

TECHNICAL FIELD

The present invention relates to liquid board comprising one or more layers of material containing cellulose. In particular, the invention relates to liquid board for aseptic packaging, which is designed to counteract the penetration, especially edge penetration, of a disinfectant with which said liquid board is treated.

BACKGROUND OF INVENTION

Packagings for the packaging of liquid products such as liquid dairy products or juices are made from coated paperboard, which is termed liquid board. This is specially designed to counteract the effect of the liquid with which it is to be filled. In particular, it is the cut edges of the paperboard that have to be protected against the penetration of liquid, so-called edge penetration. For liquid dairy products, the most aggressive component of the liquid is lactic acid. The paperboard is therefore hydrophobized against the penetration of lactic acid, which is normally achieved by means of a neutral size, i.e. a size that produces optimal hydrophobicity when it is applied at pH values above 7. Typical neutral sizes comprise at least one hydrophobic, cellulose-reactive hydrophobizing agent and an anionic, cationic or amphoteric polymer, normally a cation-active starch. The, hydrophobic, cellulose-reactive hydrophobizing agent often consists of compounds of the type alkyl ketene dimers (AKD) or alkenyl succinic anhydride (ASA). These are cellulose-reactive and bind directly to the carboxyl groups of the cellulose.

For aseptic liquid board, it is also the case that the paperboard has to be sterilized/disinfected before it is filled with the liquid food. Packagings of liquid board are normally disinfected by contact with a peroxide compound such as hydrogen peroxide solution at an increased temperature, e.g. around 70° C. Here also, however, it is the case that the liquid (disinfectant solution) must not penetrate the paperboard, the most exposed part being the cut edges. Unfortunately, however, the means normally used to prevent the penetration of lactic acid, i.e. neutral size, does not protect against the penetration of peroxide compounds, such as hydrogen peroxide. The liquid board is therefore hydrophobized conventionally against the penetration of peroxide by means of a second hydrophobizing agent, normally so-called resin size. Resin size usually comprises pine resin and/or gum resin. The resins comprise resin acids and a small portion of fatty acids. Commercially available hydrophobizing agents consist of so-called fortified resins, meaning that further carboxyl groups have been introduced to increase the retention tendency. The resin size is anchored to the cellulose surface by means of alum. Cationic resin size can be used in theory without alum, but the practical effect is better with alum.

The problem with hydrophobizing paperboard with both neutral size and with resin size is that hydrophobizing takes optimal effect at different pH values for the different sizes. As stated, neutral size works best at pH values above 7, while resin size works best at pH values below 7, meaning that a compromise solution has to be applied. However, not using the optimum pH for the two sizes means that they have to be dosed in larger quantities, incurring extra costs and also problems with the leftover chemicals that circulate in the water system, giving an unstable system with foaming and flakes etc. as a result.

In U.S. Pat. No. 5,456,800, a solution is presented to the problems named, a sizing composition being used that aims to prevent the penetration of both hydrogen peroxide and lactic acid and can advantageously be applied at a neutral to alkaline pH. The sizing composition presented comprises a thermosetting resin, a cellulose-reactive hydrophobizing agent and a non-cellulose-reactive hydrophobizing agent. The resin size and wax contain resin acids and fatty acids, which, in the case of poor retention, cause foaming and act as foam stabilizers. In U.S. Pat. No. 5,456,800, problems regarding resistance to external pressure and problems regarding hydrophobizing of paperboard layers with a low density, as below, are not discussed.

In treatment to prevent liquid penetration, account must also be taken of the density of the paperboard. The liquid board usually has a middle layer (centre layer) with a lower density than the outer layers, with the aim of giving the paperboard the desired mechanical properties, such as rigidity. The middle layer functions here as a bulk-giving layer. At low density, however, the surface energy has a smaller effect, and large quantities of size have to be dosed to achieve the desired hydrophobizing effect.

In certain types of converting equipment, furthermore, the paperboard is conveyed down into a bath of hydrogen peroxide on disinfection, the paperboard being acted upon by an external pressure that corresponds to the liquid column in the bath. With external pressure, the significance of surface chemical effects is reduced, while the capillary structure acquires greater importance. It is therefore more difficult to reduce the penetration of hydrogen peroxide through the surface chemical effect when an external pressure is present.

SUMMARY OF INVENTION

According to the present invention, a liquid board is presented that is designed to reduce or eliminate the above problem complex. The present invention thus presents a liquid board according to claim 1.

The invention assumes pressure equilibrium at the liquid face when the paperboard is treated with the disinfectant:

$$P_E+P_C=P_F$$

PE=external pressure

PC=capillary pressure

PF=flow resistance

The external pressure is constant in the disinfection system and cannot be influenced. In conventional systems, with conventional sizing, the capillary pressure is reduced in such a way that the contact angle between the penetrating liquid and fibre is increased by size dosing, which makes the paperboard hydrophobic.

The present invention is based instead on the fact that the flow resistance in the paperboard is increased, especially at the edges of the paperboard, in that one or more layers in the paperboard comprise an additive that has the capacity to react with or to decompose a disinfectant with which said liquid board is treated, in such a way that a gas layer is created on the paperboard cut, which counteracts the penetration of liquid.

According to one aspect of the invention, the gas layer is created in that a catalyst or other compound added to the paperboard brings the peroxide compound to decompose to form oxygen gas, e.g. by decomposing the hydrogen peroxide to oxygen gas and water. The catalyst or compound is selected preferably from the group consisting of metal salts, metal oxides or enzymes. Manganese ore ($MnO_2$) or catalase can be cited as examples of compounds that produce the desired effect. The oxygen gas formed forms a protective gas layer, a barrier, which prevents the peroxide compound from penetrating the paperboard, especially at its edges.

According to yet another aspect of the invention, the additive according to the invention is added in quantities of 0.5-10 kg/ton of dry paper, preferably 0.5-5 kg/ton of dry paper, and even more preferredly 1-5 kg/ton of dry paper, to the layer or layers of the paperboard that comprise the additive. The quantity used in the individual layers can thereby be adjusted relative to the density of the layer, so that the quantity is greater in the layer or layers that have the lowest density, and vice-versa. The additive according to the invention is best used in all cellulose-based layers in the liquid board.

It is also conceivable to use a compound that reacts with, rather than breaks down, the disinfectant, so that a protective gas layer is formed. The invention is not restricted either to disinfectants in the form of peroxide compounds, such as hydrogen peroxide, it also being capable of working in connection with disinfectants of another type. Here the choice of additive may be adapted to the disinfectant used, so that on reaction or breaking down, a gas layer according to the invention is formed. Moreover, it is conceivable that the additive and/or disinfectant can be chosen so that some other type of gas, i.e. other than oxygen gas, is formed during the reaction or decomposing. Examples of such gases which may be produced are hydrogen gas, carbon dioxide gas and nitrogen gas.

According to another aspect of the invention, the additive according to the invention is combined with a sizing composition, e.g. neutral size, to counteract the penetration of lactic acid. Here the pH used on hydrophobizing can advantageously be optimized for the neutral size, meaning that pH values above 7 can be used.

Most advantageously, only the additive according to the invention is used to counteract the edge penetration of disinfectants. According to an aspect of the invention, however, the additive according to the invention can be combined with a hydrophobizing agent, e.g. resin size, to counteract the edge penetration of the disinfectant. The resin size can be used in this case in quantities that are smaller than conventionally, in the layer or layers comprising the additive according to the invention.

In the manufacture of the liquid board, the additive according to the invention is preferably added to the stock prior to the inlet box. If the additive is in powder form, for example manganese ore, the additive is best added in the form of a slurry. If the additive is dispersed or in solution, for example, catalase, the additive is best added in the existing form.

The liquid board in which the additive is used is preferably constructed of at least one bulk-giving centre layer, with an outer layer on each side. The centre layer is normally formed of a mixture of chemical pulp and CTMP pulp. A coating layer of PE is normally provided on the outside of the liquid board, while the inside is coated with a coating layer of PE and possibly aluminium, which forms a barrier against the liquid that the packaging is intended to be filled with.

EXAMPLE

Figure 1:
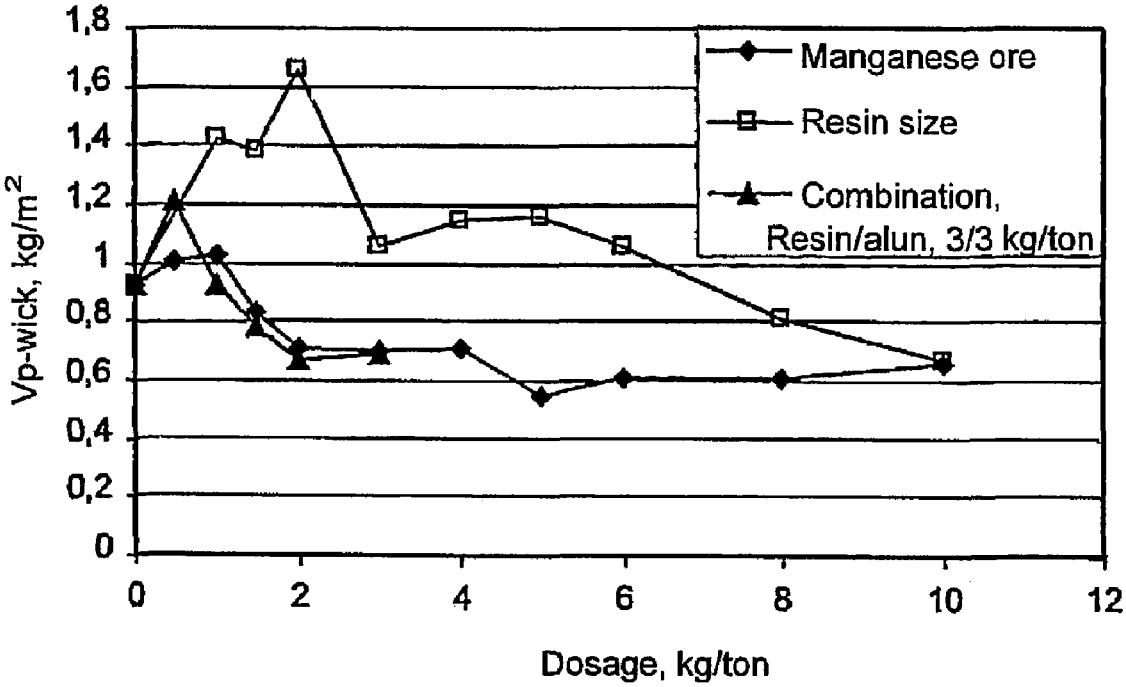
FIG. 1 shows edge penetration in the form of the VP-wick values achieved for a reference experiment and two experiments according to the invention, with different dosing.

A series of experiments was carried out on a laboratory scale, a centre layer pulp being used consisting of chemical pulp and CTMP pulp in the form of inlet box stock. The pulp used was neutrally sized using AKD (4 kg/ton). The reference consisted of the above pulp with the addition of resin size and alum. In the series of experiments, manganese ore ($MnO_2$) was then added alone or in combination with resin size and alum. In the series of experiments in which the manganese ore was dosed together with resin size and alum, a constant dose of resin size and alum was always used (3 kg/ton of each chemical). Sheets were manufactured from the stock, following which the edge penetration of hydrogen peroxide was determined under atmospheric pressure. Determination of the hydrogen peroxide penetration was carried out in the laboratory in a hydrogen peroxide bath with 30% hydrogen peroxide at a temperature of 70° C. The dwell time was 10 minutes.

The resulting edge penetration, measured in the form of VP-wick values, is shown in Table 1, it being possible to confirm that the same levels of VP-wick were obtained when the additive according to the invention, or the combination of manganese ore/resin size, was used, as when resin size was used. This means that the same minimum level of VP-wick can be achieved with manganese ore as with resin size. The dosage can however advantageously be made lower, as the effect is achieved more quickly. The result is also shown in diagrammatic form in FIG. 1.

TABLE 1

| | VP-wick, kg/m$^2$ | | |
|---|---|---|---|
| Dosage kg/ton | Resin size and alum (no manganese ore) Reference | Manganese ore (no resin size or alum) | Manganese ore with a constant dose of resin size and alum |
| 0 | 0.93 | 0.93 | 0.93 |
| 0.5 | | 1.01 | |
| 1.0 | 1.42 | 1.03 | 1.21 |
| 1.5 | 1.38 | 0.83 | 0.93 |
| 2 | 1.66 | 0.71 | 0.78 |
| 3 | 1.06 | 0.70 | 0.67 |
| 4 | 1.15 | 0.71 | 0.69 |
| 5 | 1.16 | 0.55 | |
| 6 | 1.06 | 0.61 | |
| 8 | 0.81 | 0.61 | |
| 10 | 0.67 | 0.66 | |

The invention claimed is:

1. Method of manufacture of liquid board comprising one or more layers of material containing cellulose, comprising:

adding an additive selected from the group consisting of catalase and manganese ore ($MnO_2$) to pulp; and forming at least one layer of material containing cellulose and the additive from the pulp, said liquid board comprising one or more layers of the material containing cellulose and the additive, said additive being present in the at least one layer of material in an amount such that when the liquid board is sterilized with a disinfectant the additive reacts with or decomposes said disinfectant to form a gas which acts as a barrier and thereby prevents penetration of said disinfectant into the liquid board.

2. A method according to claim 1, wherein the additive comprises manganese ore.

3. A method according to claim 1, wherein said gas is oxygen gas, hydrogen gas, carbon dioxide gas or nitrogen gas.

4. A method according to claim 1, further comprising adding said additive in a quantity of 0.5-10 kg/ton of dry paper in said one or more layers that comprise the additive.

5. A method according to claim 1, further comprising forming to layers of material, a first layer of material having a lower density than a second layer of material, and wherein said first layer of material has a higher content of said additive than the second layer of material.

6. A method according to claim 1, further comprising adding a second agent to said pulp, which second agent counteracts penetration of lactic acid into the liquid board.

7. A method according to claim 1, further comprising adding a hydrophobizing agent to the pulp, which hydrophobizing agent counteracts penetration of the disinfectant into the liquid board.

8. A method according to claim 1, wherein said gas acts a barrier to prevent edge penetration of said disinfectant into the liquid board layer/layers.

9. A method according to claim 1, wherein said disinfectant is a peroxide compound.

10. A method according to claim 1, wherein said disinfectant is hydrogen peroxide.

11. A method according to claim 1, further comprising adding said additive in a quantity of 0.5-5 kg/ton of dry paper in said one or more layers that comprise the additive.

12. A method according to claim 1, further comprising adding said additive in a quantity of 1-5 kg/ton of dry paper in said one or more layers that comprise the additive.

13. A method according to claim 6, wherein said second agent counteracts edge penetration of lactic acid into the liquid board, said second agent consisting of a sizing composition comprising at least one hydrophobic, cellulose-reactive hydrophobizing agent and an anionic, cationic or amphoteric polymer.

14. A method according to claim 1, further comprising adding a hydrophobizing agent to the pulp, which hydrophobizing agent is suitable for counteracting edge penetration of the disinfectant into the liquid board, said hydrophobizing agent consisting of resin size.

* * * * *